United States Patent [19]

Morris et al.

[11] 4,034,572

[45] July 12, 1977

[54] REFRIGERATED FRONT AND REAR LOADING DAIRY HANDLING CASE

[75] Inventors: Herbert R. Morris, Morrisville; James Henry, Levittown, both of Pa.

[73] Assignee: Emhart Industries, Inc., Farmington, Conn.

[21] Appl. No.: 715,969

[22] Filed: Aug. 20, 1976

[51] Int. Cl.[2] ..... A47F 3/04; F25D 15/00; F25D 23/12; G03F 7/02

[52] U.S. Cl. ..... 62/256; 98/33 R; 62/237; 62/260; 62/458

[58] Field of Search ..... 62/256, 237, 255, 257, 62/253, 458, 259, 260, 246, 249; 98/33 R

[56] References Cited

U.S. PATENT DOCUMENTS

| | | | |
|---|---|---|---|
| 2,209,263 | 7/1940 | Gaines | 98/33 R |
| 2,281,002 | 4/1942 | Eck | 98/33 R |
| 3,123,988 | 3/1964 | Richman | 62/256 |
| 3,392,543 | 7/1968 | Miller | 62/256 |
| 3,478,535 | 11/1969 | Perez et al. | 62/237 |
| 3,507,322 | 4/1970 | Tetrick et al. | 62/237 |
| 3,690,118 | 9/1972 | Rainwater | 62/256 |
| 3,698,205 | 10/1972 | Perez | 62/256 |

*Primary Examiner*—Lloyd L. King
*Attorney, Agent, or Firm*—Sperry and Zoda

[57] ABSTRACT

An open-fronted refrigerated display case permitting shoppers direct access to goods displayed therein which also allows loading thereof by the movement of a loaded cart into a stationary location within the display case from the front direction or the rear direction, the case including a stationary housing which defines a refrigerated enclosure which further defines a front opening and a rear wall area and a case floor, the front opening having an air curtain extending thereover created by the passage of refrigerated air from air outlets along the upper edge of the front opening to air inlets along the lower edge of the front opening, also including an air circuit means to communicate the air from the inlet to the outlet and through the refrigeration device to form the air curtain from refrigerated air, also including a door means extending over at least a portion of the rear wall area with the remainder of the rear wall area covered by a curtain means, the door means being mounted within at least one track and the insulating curtain being mounted immediately adjacent the single track such that the door is slidably mounted within the track and when moved to an open position the curtain collapses allowing entry of the movable cart from the rear direction, and when the slidably mounted door is closed the curtain will expand to isolate the environment within the refrigerated case from the external environment, the case also including vertical air conduits within the hollow rear doors to aid in the communication of air from the air inlets at the bottom of the open front to the air outlets at the top of the open front, the movable carts adapted to be moved into the refrigerated enclosure from the rear direction through the door means or from the front direction through the open front area.

10 Claims, 3 Drawing Figures

REFRIGERATED FRONT AND REAR LOADING DAIRY HANDLING CASE

BACKGROUND OF THE INVENTION

1. Field Of The Invention

The present invention deals with the field of roll-in refrigerated display cases which are adapted to receive movable carts to facilitate loading thereof. When handling bulky materials such as dairy products like milk and so forth, it is advisable to provide a system for display which eliminates or at least minimizes handling of the bulky material. Therefore, refrigerated display cases have been devised such that the transporting cart which carries the goods to the display location may be moved directly into the case and thereby accomplish the dual purposes of transporting the goods to the display case and holding the goods within the display case.

2. Description Of The Prior Art

Many of the designs of the prior art have utilized complicated air flow circuitry to maintain the refrigerated air flow curtain over the open front area. The problem of maintenance of this circuitry is particularly difficult in roll-in cases since a closes air flow circuit over the open front or open rear areas provides inherent difficulties. Some designs such as U.S. Pat. No. 3,392,543 have utilized the mobile cart itself as one wall or one portion of the ducting of the air flow circuitry. The present invention does not require the placement of a cart within the case in order to create a closed full air flow circuitry and therefore is more adaptable to varied usages and applications. Other patents such as U.S. Pat. No. 3,478,535 and 3,690,118 show systems for roll-in refrigerated cases in which the carts are rolled into the case solely from the front direction. The present application provides a case in which the display cart may be universally moved from the front direction or the rear direction to a resting display location within the case. This desired result is achieved by a new and novel rear curtain design in combination with hollow sliding doors which are mounted within a single track and which provide the upwradly extending air carrying means within the hollow sections of the doors. Also with this design cost is minimized due to the use of a single track in which all the doors are mounted which is made possible by the placement of a folding thermally insulating curtain between adjacent hollow door sections.

SUMMARY OF THE INVENTION

The present invention comprises a universal roll-in refrigerated display case which has an open front design which permits shoppers direct access to goods displayed therein. The case includes a stationary housing with a front opening adjacent the shopper aisle to allow customer access to the goods. Within the stationary housing is defined a refrigerated enclosure which is bounded by a rear wall area and a case floor.

The front opening includes an air curtain extending thereacross which is achieved by an air outlet means along the upper end of the front opening and an air inlet means along the lower end of the front opening. Cold air travels from the outlet means downwardly in a sheet or curtain form to be received within the air inlet means. This refrigerated air then flows from the air inlet means through an air circuit means which communicates this air through a refrigerating means and on toward the air outlet means.

At the rear of the case a door means and a thermal insulating curtain are located across the rear wall area. Preferably adjacent each door means or between each pair of door means is a collapsable and expandable curtain means. The door means is mounted within a single track to minimize cost and the thermally insulating curtain means is mounted above this track and between adjacent door sections. When it is desirable to move a cart into a display location within the refrigerated enclosure the slidably mounted door means is moved along the track in a sideward direction which compresses or collapses the curtain means and provides an opening in which the movable cart means may be moved to a display location within the case from behind the case. The door is then closed. Once the dairy or other bulk goods upon the movable cart have been emptied by the customers, the rear door may again be slidably moved in a transverse direction to allow movement of the cart out through the rear open area of the case.

Alternatively, the movable cart means can enter or exit the display location within the refrigerated enclosure through the front area when using the design shown in FIG. 3. The cart may be moved outward through the front or inward through the front and similarly may be moved outward or inward through the back section.

The circuitry means which communicates from the air inlet to the air outlet includes a vertical air conduit extending upwardly from the rear of the case floor to the rear of the case top. This vertical air conduit is provided by the hollow interior walls of the movable door means. The track in which the door means is mounted preferably includes a slot or similar aperture which communicates air flow from the air inlet to provide fluid flow communication upwardly to the refrigeration means and on to the air outlet at the top of the open front area.

In another embodiment of the present invention a channeling conduit or panel may extend across the lower front section of the open front area. This channeling conduit will define therein at least one channeling aperture which will aid in the flow of air from the lower edge of the air curtain to the inlet. Also this channeling conduit will provide a decorative lower panel to the front of the refrigerated display case.

It is an object of the present invention to provide a roll-in refrigerated display case which universally allows the movement of a movable cart means into a display location within the refrigerated enclosure from the front or rear directions.

It is an object of the present invention to provide a refrigerated display case which is simple in design and economical in cost of manufacture which allows movement of a movable cart means into a display location within a refrigerated enclosure from the rear direction.

It is an object of the present invention to provide a refrigerated display case which includes rear door sections extending from the floor upwardly in which the floor is at approximately the same level as the surrounding store and aisle area to facilitate the movement of the cart therein.

It is an object of the present invention to provide a refrigerated display case of the open front design having hollow rear doors which provide the vertical conduit for carrying the refrigerated air and thereby eliminating the need for vertically extending posts or conduits positioned at locations along the rear of the roll-in case.

It is an object of the present invention to provide a refrigerated display case in which the return duct extending from the front air inlet to the rear vertically extending air conduit is located below case floor and below the level of the store floor.

It is an object of the present invention to provide a refrigerated display case including a channeling conduit to aid in the flow of air from the bottom of the refrigerted air curtain to the air circuit means which communicates this air to the refrigeration means.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
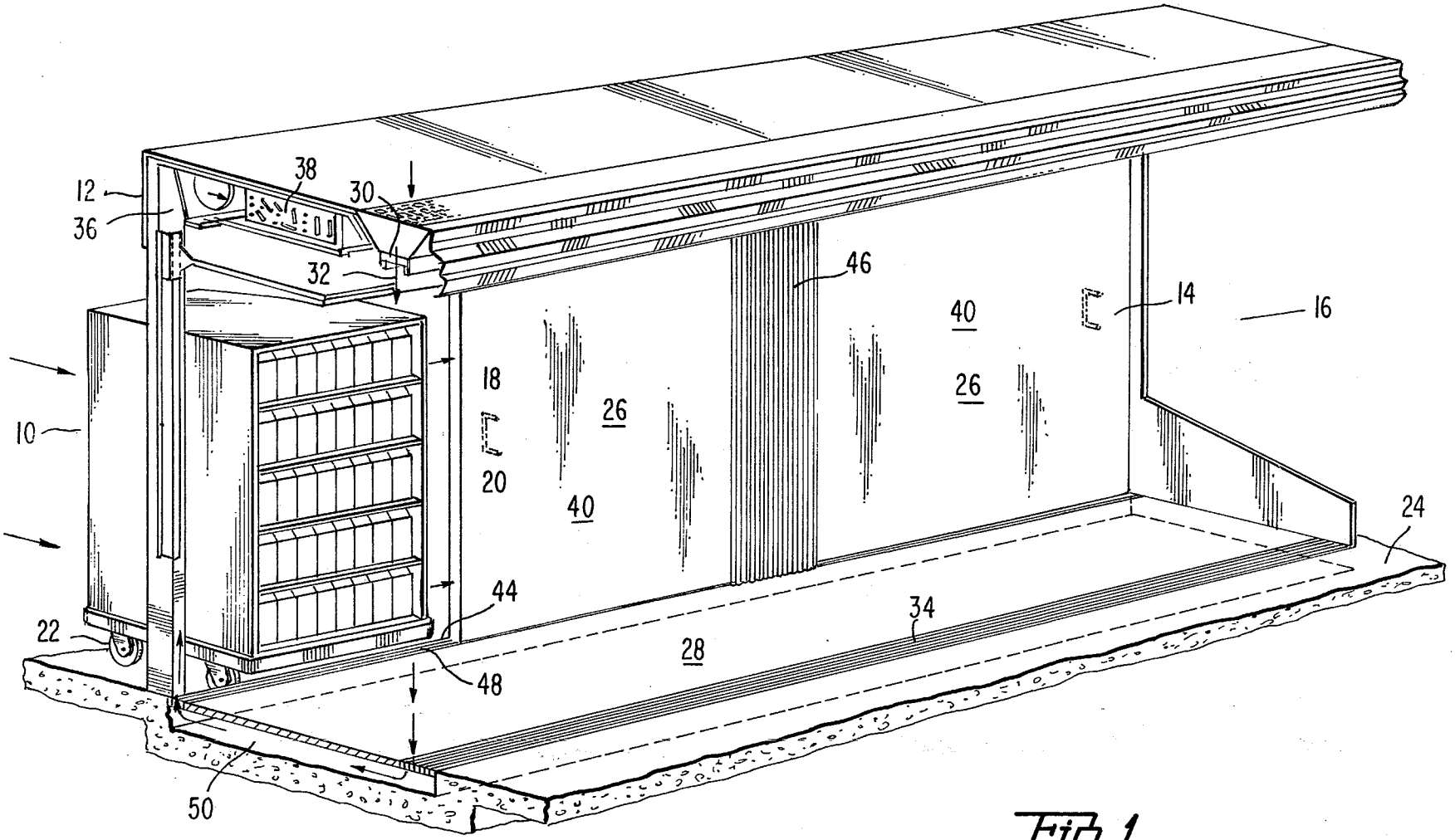
FIG. 1 is a perspective view of an embodiment of the universal roll-in refrigerated display case of the present invention.
Figure 2:
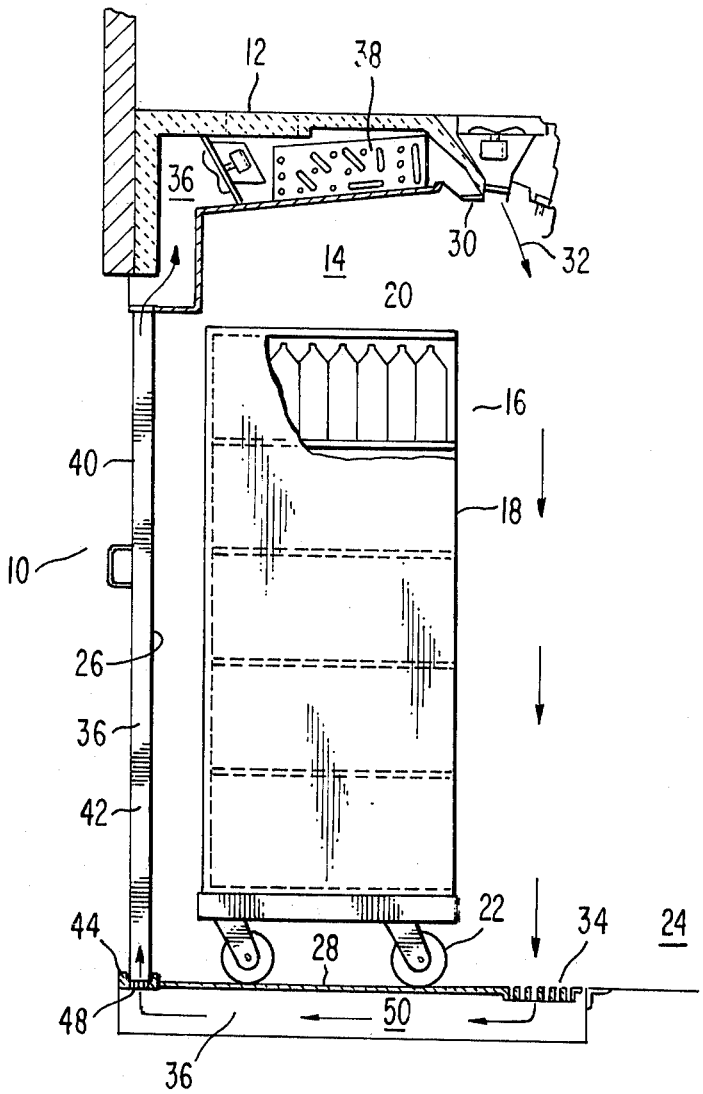
FIG. 2 is a side plan view of the universal roll-in refrigerated display case shown in FIG. 1.

A universal roll-in refrigerated display case 10 is shown in FIG. 1. The case 10 includes a stationary housing 12 extending upwardly from the floor of the store area to form a refrigerated enclosure 14. The refrigerated enclosure defines a front opening 16 to permit full and free access to the goods displayed within the enclosure 14 to customers or shoppers located within the shoppers aisle 24.

In the embodiment shown in FIG. 1 a movable cart means 18 is adapted to carry goods 20 to a display location within the refrigerated enclosure 14 by rolling the movable cart means 18 onto the case floor 28. This movement may be made from the aisle side of the stationary housing 12 or from the rear of the housing. To facilitate this movement, case floor 28 is preferably at the same level as the surrounding floor of the store. Wheeled members 22 are included in the cart means 18 to facilitate movement thereof. The wheeled members 22 may be casters, wheels or other rolling devices.

Figure 3:
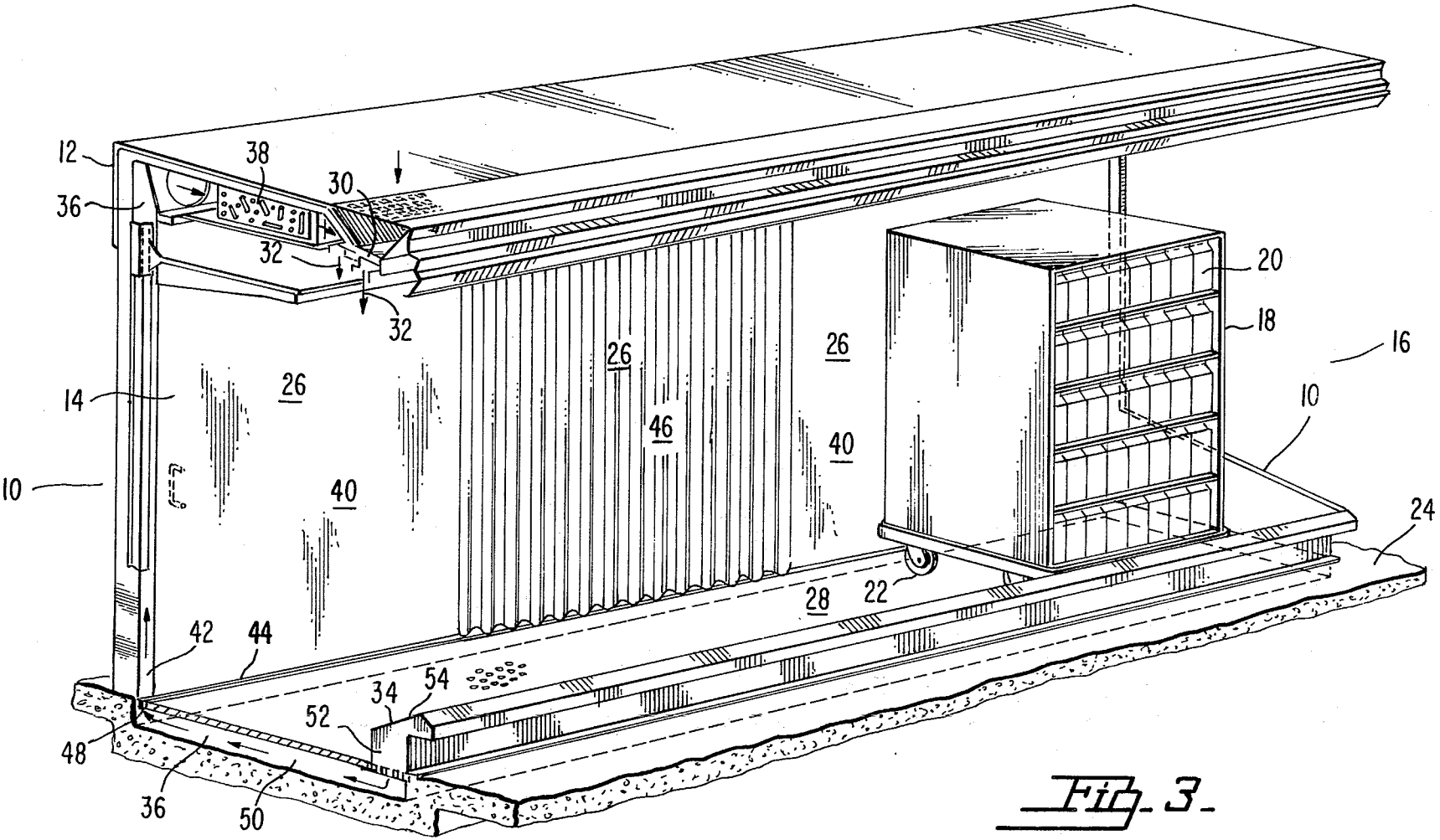
FIG. 3 is a perspective view of another embodiment of the present invention showing movement of the movable display cart through the open rear door.

The refrigerated enclosure 14 is defined by the case floor 28, the rear wall area 26 and the front opening 16. A downwardly moving air curtain 32 travels over the front opening moving from the air outlet means 30 to the air inlet means 34. This air then flows from the air inlet means 34 through an air circuit means 36 to be refrigerated by refrigerated means 38 and thereby provide a supply of fully refrigerated air to the air outlet means 30. The path of the flow of air through the air circuit means 36 includes an upward flow through vertical air conduits 42 which are formed within the hollow rear door means 40. These vertical air conduits carry air upwardly from a return duct 50. The return duct 50 is in fluid flow communication with the air inlet means 34 at the bottom of the air curtain 32. In some embodiments as shown in FIG. 3, a channeling conduit 52 extends across the lower front section of the case 10 to aid in the flow of refrigerated air to the air inlet means 34. A channeling aperture 54 is defined by the channeling conduit 52 to receive air and be in fluid flow communication with air inlet means 34. In this manner air flow through the air inlet means 34 is most efficiently achieved.

The door means 40 is preferably slidably mounted within a track means 44 which can preferably be singular. Due to a curtain means 36 adjacent each rear door 40 and with a single track means 44, slidably mounted door means 40 may be moved laterally to thereby allow the movement of movable cart means 18 into and out of a stationary location upon the case floor 28 within the stationary housing 12. After this movement operation the door means 40 will slidably be returned to its closed position. In the closed position the vertical air conduits 42 will carry air through the air circuit means 36 upwardly through the hollow interior vertical air conduits 42. To facilitate movement of air from the return duct 50 to the vertical air conduits 42 a slot 48 may be defined within the single track means 44 to operated as an aperture to allow the flow of air therethrough. In this manner fluid flow communication between the return duct 50 and the hollow interior vertical air conduits 42 is achieved. To allow the lateral slidable movement of the door means 40 a curtain means 46 may be positioned above the slotted single track means 44. This curtain means 46 will be adapted to be collapsible and expandable such that when the door means 40 is opened the curtain means 46 will collapse and when the door means is closed the curtain means will expand. The curtain means 46 is preferably made of a thermally insulated material to minimize loss of refrigerated air through the open section of the rear wall area 26. This open rear section is defined as those areas of the rear wall area 26 over which the door means 40 does not extend when all doors are in the fully closed position.

In another configuration the curtain means 46 may be omitted and the entire rear area of the case may be covered by doors. In this design multiple tracks 44 will be desired and increased vertical flow of return air will be achieved by the increase in cross-sectional area of vertical air conduits 42 due to the additional hollow third door.

To assure effective operation of the door means 40 a portion of the rear wall area 26 will be covered by the curtain means 46 rather than door means 40. Adjacent each door means 40 shall be a portion of curtain means 46 to allow the door means to be slid laterally within the track means 44 to collapse the curtain means 46 to thereby allow movement of movable cart means 18 carrying goods 20 to a stationary display location. Once the movable cart means 18 has been located within the refrigerated enclosure the door means 40 may be moved to the closed position to allow the curtain means 46 to expand and again provide a thermally insulating surface between the ambient environment behind the case 10 and the refrigerated environment within the refrigerated enclosure 14. It should be appreciated that it will not be necessary to use a curtain means 46 which is thermally insulating whenever the case is used with the rear area thereof in abutment with a cooled area. However, with such a design it is necessary to use a curtain means anyway in order to minimize air circulation between the cooled rear environment and the interior of the case. Such an air flow would be detrimental to the full and even flow of the air curtain means 30.

One of the primary problems with roll-in refrigerated display cases has been the communication of air from the lower return duct upwardly to the refrigeration means which is usually located in the top of the case 10. With most prior art cases a plurality of vertically extending hollow posts have been included every few feet along the rear of the case. These posts provide the vertical conduits through which the air returning from the lower edge of the refrigerated air curtain is moved upwardly. These posts are obstructions to the movement of movable carts and the like through the rear area of the case to the display location within the refrigerated environment. The present invention provides a simple and economic system for communicating this air upwardly through the rear of the case without utilizing these fixedly positioned posts. To provide this design a plurality of slidably mounted doors comprise a rear door means 40. Adjacent each of these door means is a collapsible curtain means 46. In the embodiments shown in FIGS. 1 and 3 the thermally insulating curtain is shown in the collapsed and expanded positions, respectively. The collapsible curtain extends between adjacent sliding door sections to thermally insulate the refrigerated environment from the ambient environment. In this manner the door sections may be mounted within a single track means and thereby not require dual or triple track means which are often required in overlapping slidable door sections. Therefore a simple and economical single lower track may be used which has obvious inherent cost advantages.

When used with an underground return duct 50, a slot may be defined within the single track means 44 to communicate air flow between the bottom of the refrigerated air curtain 32 and the interior hollow section or vertical air conduits 42 of the rear doors 40. This air which moves upwardly through the vertical air conduits will be cooler than the ambient environment but will most likely require further cooling by refrigeration means 38 prior to movement through air outlet means 30 since some mixing and warming of the air occurs during movement through the entire air flow path.

The refrigerated display case 10 of the present invention is made universal by the adaptability for the movement of the movable cart means 18 to a point within the refrigerated enclosure 14 from the front or rear direction. In this manner the case is adaptable to various usages at any desired location throughout the store area. This universal movement is further facilitated by case floor 28 being located at approximately the same level as the surrounding store floor area. Often it will not be necessary to allow direct movement from the front section and within these design parameters, a channeling conduit 52 may extend across the lower front section of the refrigerated display case as shown in FIG. 3 to provide a communicating conduit between the lower end of the refrigerated air curtain and the return duct 50 and also to provide a decorative lower front panel to the case design.

The design of the rear wall area 26 as shown in the embodiments of the Figures is particularly efficient in cost and space saving. As shown in FIG. 3 the rear wall area 26 may be divided into three sections in which the center section is a folding curtain and the two laterally extending surfaces are covered by slidably mounted doors. In this manner a movable display cart may be moved to a display location within the refrigerated enclosure 14 through either of the rear doors by slidably moving the doors to the lateral locations, or a movable cart my be moved to the center location by collapsing the folding curtain to one side or the other. Again, each of these rear wall area sections is slid to the closed position after the cart has been moved. In this manner a full air flow circuit means 36 extends from the air inlet means 34 to the air outlet means 36 regardless of whether all, none or merely some of the carts are located at their stationary positions within the refrigerated enclosure 14. Many prior art systems have utilized the carts themselves as a portion of the conduits which comprise the air circuit means 36, however the air circuit means 36 of the present invention is entirely independent of the movable cart means 18 and therefore provides full circuit flow with none or some of the carts being positioned in the display location. Thus the refrigerated environment is maintained at all times rather than only during certain cart configurations.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. A universal roll-in refrigerated display case, of the open-front design to permit shoppers direct access to goods displayed therein, which comprises:

a. a stationary housing defining a refrigerated enclosure therein, said housing also defining a front opening to provide direct access to goods displayed within said enclosure from an adjacent shopper's aisle, said housing including a rear wall area at the opposite side of the case from the aisle and case floor, said case floor being at approximately the same level as the surrounding store floor;

b. air outlet means along the upper portion of said front opening to release a curtain of refrigerated air moving downwardly extending across said front opening;

c. air inlet means along the lower portion of said front opening to receive air from the downwardly moving curtain;

d. air circuit means extending from said inlet means to said outlet means to provide an air flow path therebetween;

e. refrigeration means positioned within said air circuit means for cooling the air prior to flow through said air outlet means;

f. door means positioned in said rear wall area of said housing extending upward from the level of said case floor, said door means being movable from a closed position to an opened position to allow movement of goods into said enclosure for display, said door means being hollow to define therein vertical air conduits which provide a portion of said air circuit means for carrying air from said inlet means to said outlet means; and g. movable cart means adapted to transport goods to a display location within said housing from a storage location, said cart means adapted to be selectively moved into and out of a display position within said housing through said front opening and to be selectively moved into and out of a display position within said housing through said rear wall area when said door means is opened.

2. The case as defined in claim 1 including a single track means within said case floor along said rear wall area within which said door means is slidably mounted.

3. The case as defined in claim 2 including a multiple track means within said case floor along said rear wall area within which said door means is slidably mounted.

4. The case as defined in claim 1 further including a single track means within said case floor along said rear wall area and a curtain means adjacent said track means, said single track means having said door means movably mounted therein, said curtain means extending over a part of said rear wall area to insulate the refrigerated environment within said enclosure from the external ambient environment, said curtain means adapted to be laterally compressed by movement of said door means to an open position and adapted to laterally expand by movement of said door means to the closed position.

5. The case as defined in claim 1 wherein said air circuit means includes a return duct extending from said air inlet means to the bottom rear of the case and further including a slot defined within said track means to provide a flow path for air from said return duct to said vertical air conduits within said door means.

6. The case as defined in claim 5 wherein said return duct is positioned below said case floor.

7. The case as defined in claim 1 further comprising a channeling conduit fixedly mounted adjacent said case floor along the lower edge of said front opening, said channeling conduit defining therein a channeling aperture to receive air from the lower portion of the air curtain, said channeling conduit and said channeling aperture being in air flow communication with said air inlet means.

8. The case as defined in claim 1 wherein said air inlet means and said air outlet means each include a plurality of openings to provide multiple air curtains over said front opening.

9. The case as defined in claim 1 wherein said movable cart means includes wheeled members such as rollers, casters, wheels and the like to facilitate movement thereof.

10. A universal roll-in refrigerated display case, of the open-front design to permit shoppers direct access to goods displayed therein, which comprises:

a. a stationary housing defining a refrigerated enclosure therein, said housing also defining a front opening with an air curtain moving thereover to provide direct access to goods displayed within said enclosure, said housing including a rear wall area and a case floor, said case floor being at approximately the same level as the surrounding store floor, said housing further including a channeling conduit extending along the lower edge of said front opening, said channeling panel defining channeling apertures therethrough to receive air from the bottom of the air curtain;

b. at least one air outlet means along the upper portion of said front opening to release a curtain of refrigerated air moving downwardly extending across said front opening;

c. at least one air inlet means along the lower portion of said front opening to receive the air from said channeling conduits;

d. air circuit means providing an air flow path from said inlet means to said outlet means to maintain an air curtain over said front opening, said circuit means including an air return duct extending below said case floor from said air inlet means to the rear of said enclosure;

e. refrigeration means within said air circuit means for cooling the air prior to flow through said outlet means;

f. door means positioned in said rear wall area of said housing extending upward from the level of said case floor, said door means being slidable from a closed position to an open position to allow movement of goods into said enclosure for display, said door means being hollow to define therein vertical air conduits which provide a portion of said air circuit means for carrying air from said inlet means to said outlet means;

g. single track means extending at floor level along the rear of said case, said door means being mounted for slidable movement within said single track means, said track means defining a slot therein to provide air flow communication for said air circuit means from said return duct to said vertical air conduits;

h. a curtain means positioned along said rear wall area above said single track means and adjacent each of said door means, said curtain means providing thermal insulation between said refrigerated enclosure and the ambient environment, said curtain means being compressible by opening of said door means for loading of the case and expandable responsive to closing of said door means; and i. movable cart means adapted to carry goods from a storage location to a display location within said housing, said cart means adapted to be selectively moved into and out of a display position within said housing through said front opening and to be selectively moved into and out of a display position within said housing through said rear wall area when said door means is open.

* * * * *